US006724136B1

(12) United States Patent
Kim et al.

(10) Patent No.: US 6,724,136 B1
(45) **Date of Patent: *Apr. 20, 2004**

(54) SHADOW MASK FOR COLOR CATHODE-RAY TUBE

(75) Inventors: Sung Dae Kim, Daejeon (KR); Sang Hu Park, Kyungki-Do (KR)

(73) Assignee: LG Electronics Inc., Seoul (KR)

( * ) Notice: Subject to any disclaimer, the term of this patent is extended or adjusted under 35 U.S.C. 154(b) by 18 days.

This patent is subject to a terminal disclaimer.

(21) Appl. No.: 09/639,119

(22) Filed: Aug. 16, 2000

(30) Foreign Application Priority Data

Aug. 17, 1999 (KR) ..... 1999-33836

(51) Int. Cl.[7] ..... H01J 29/80
(52) U.S. Cl. ..... 313/402; 313/404; 313/407
(58) Field of Search ..... 313/402, 404, 313/405, 407

(56) References Cited

U.S. PATENT DOCUMENTS 3,585,431 A * 6/1971 Long ..... 313/286
4,437,036 A * 3/1984 Ragland, Jr. ..... 313/402
5,929,558 A * 7/1999 Lee ..... 313/402
6,111,346 A * 8/2000 Ito et al. ..... 313/402
6,140,754 A * 10/2000 Ko ..... 313/402
6,259,194 B1 * 7/2001 Ito et al. ..... 313/402
6,323,589 B1 * 11/2001 Inoue et al. ..... 313/402

* cited by examiner

*Primary Examiner*—Nimeshkumar D. Patel
*Assistant Examiner*—Matt Hodges
(74) *Attorney, Agent, or Firm*—Fleshner & Kim, LLP

(57) ABSTRACT

The present invention relates to a shadow mask comprising an effective surface including electron beam passage holes all over, an ineffective surface having a certain width surrounding the circumference of the effective surface, a skirt portion curved formed on the circumference of the ineffective surface, and concave-compressed beads formed on the ineffective surface along the skirt portion in order to improve the stiffness of the effective surface. The present invention can prevent distortions of a screen by forming the beads on the ineffective surface which is capable of improving stiffness of the shadow mask by increasing a lot value of the section modulus performing a function resisting the relative vibration occurred between the effective surface and skirt portion.

27 Claims, 5 Drawing Sheets

SHADOW MASK FOR COLOR CATHODE-RAY TUBE

BACKGROUND OF THE INVENTION

1. Field of the Invention

The present invention relates to a shadow mask for a color CRT (Cathode-Ray Tube), in particular to the shadow mask for the color CRT which is capable of preventing a distortion phenomenon (uneveness) of a screen due to outer vibrations and impacts by improving stiffness of the shadow mask.

2. Description of the Prior Art

In general, a shadow mask installed at the rear end of a panel of a color CRT (Cathode Ray Tube) performs a function for getting each electron beam radiated from a electron gun thrown accurately each color of a fluorescent screen corresponding to the electron beam, particularly it can be shaken due to outer vibrations and impacts and can be directly damaged by the outer vibrations and impacts. Accordingly, strengthen stiffness of the shadow mask is required in order to get high visibility of the screen.

However, it is impossible to form beads on an effective surface of the shadow mask different to other parts, but it is possible to form the beads on an ineffective surface as a framework of the shadow mask in order to improve the stiffness of the shadow mask.

As depicted in FIG. 1. and FIG. 3B., the conventional shadow mask will now be described.

The conventional shadow mask comprises a front panel 1 installed on the front side of the color CRT, a three color fluorescent screen 1*a* having a red R, green G, blue B color installed on the inner side surface of the panel 1, a shadow mask 5 which is supported by a frame 6 and is installed on the rear portion of the panel having a certain distance from the fluorescent screen 1*a* in order to make an electron beam 10 throw electron beams accurately on the fluorescent screen 1*a*, the frame 6 supporting the inner upper and lower end of the panel 1 by a spring 4, an inner shield 11 combined to the rear end of the frame 6 in order to prevent electron beam 10 from being influenced by an outer magnetic field.

The red, green, blue colors electron beam 10 radiated by an electron gun 3 is deflected toward the fluorescent screen 1*a* by the vertical and horizontal deflection magnetic field of a deflection yoke 8, is subdivided by passing through electron beam through holes of the shadow mask, and illustrates an image by being thrown on the fluorescent screen 1*a*.

Meanwhile, the electron beam 10 radiated by the electron gun 3 has to be accurately thrown the fluorescent screen 1*a* corresponding to the each color, when the outer impact and vibration are transferred to the shadow mask 5, the electron beam 10 can not be thrown accurately on the fluorescent screen 1*a* in accordance with the each color, but is deviated, and wave figures occur on the fluorescent screen 1*a*.

This is called as a microphonic phenomenon, in order to prevent directly the phenomenon, the stiffness of the shadow mask 5 has to be improved.

In addition, a drop impact experiment is performed on the color CRT, when there is distortion of the shadow mask as above, the screen 1*a* is uneven, accordingly credibility of the product lowers.

In order to decrease distortion of the shadow mask 5, as depicted in FIG. 3, a hemispherical bead 15 having hemispherical cross section (A-A') can be formed on the ineffective surface as the circumference of the effective surface 16 of the shadow mask 5, or as depicted in FIG. 3B, a stepped bead 15 having stepped cross section (B-B') is formed.

A non described reference numeral 5*a* illustrates a skirt portion combining to the frame 6.

According to the conventional technology, the hemispherical bead or the stepped bead 15 is formed on the ineffective surface of the shadow mask 5, but it does not actually improve the stiffness of the shadow mask 5.

Meanwhile, FIG. 4. illustrates shapes of major vibration modes. Herein, when the ineffective surface of the shadow mask 5 moves up and down due to the outer vibration, the skirt portion 5*a* moves naturally left and right as depicted in FIG. 5.

In the portion corresponding to a certain length 1, the relative vibration ranges of the effective surface 16 and skirt portion 5*a* are in proportion to a section modulus I corresponding to the length 1. In other words, when the section modulus is getting bigger, the relative vibration ranges of the effective surface 16 and skirt portion 5*a* are getting smaller, and the stiffness of the shadow mask 5 is getting improved.

On the contrary, as depicted in FIG. 5., when there is no bead on the ineffective surface, the section modulus I of the ineffective surface can be illustrated as below.

$$I = \frac{lt^3}{12} \qquad \text{[Equation 1]}$$

Thickness of the most shadow masks 5 is thin, accordingly the section modulus value is small, accordingly the relative vibration occurs easily.

Herein, in order to improve the stiffness of the shadow mask 5, the relative vibration has to be prevented by keeping a certain angle (θ(t)) between the effective surface 16 and skirt portion 5*a*.

The bead shapes depicted in FIG. 3A and FIG. 3B influence the section modulus I so as to be small, accordingly the beads according to the FIG. 3A and FIG. 3B can not help increase of the stiffness of the shadow mask 5.

SUMMARY OF THE INVENTION

It is an object of the present invention to provide a shadow mask for a color CRT which is capable of increasing an impact character and a vibration character by strengthening stiffness of the shadow mask by improving shapes of beads formed on an ineffective surface of the shadow mask so as to increase a section modulus.

In order to achieve above mentioned objects, the shadow mask of the present invention comprises an effective surface having electron beam passage holes all over, an ineffective surface having a certain width surrounding circumference of the effective surface, a skirt portion curved formed on the circumference of the ineffective surface, and concave-compressed beads formed on the ineffective surface along the skirt portion direction in order to improve the stiffness of the effective surface.

In the concave-compressed bead of the preferred embodiment of the present invention, it is advisable to form a plurality of the concave-compressed beads along the circumference of the shadow mask with a certain interval.

In addition, it is advisable to form the plurality of the concave-compressed beads sequentially along the circumference of the shadow mask.

In the other embodiment of the present invention, it is advisable to form a stepped bead having at least two steps.

In addition, when overall length of the ineffective surface is $L_1$ and length from a dotted line to a concave-compressed bead forming portion is $L_2$ (ref. FIG. 8), it is advisable for satisfying the range $0.3<L_2/L_1<0.8$.

And, when overall length of the skirt portion is $H_1$ and length of the concave-compressed bead on the skirt portion is $H_2$ (ref. FIG. 8), it is advisable for satisfying the range $0.3<H_2/H_1$.

DETAILED DESCRIPTION OF THE PREFERRED EMBODIMENT

Hereinafter, the preferred embodiments of the present invention will now be described with reference to the accompanying drawings.

Figure 6:
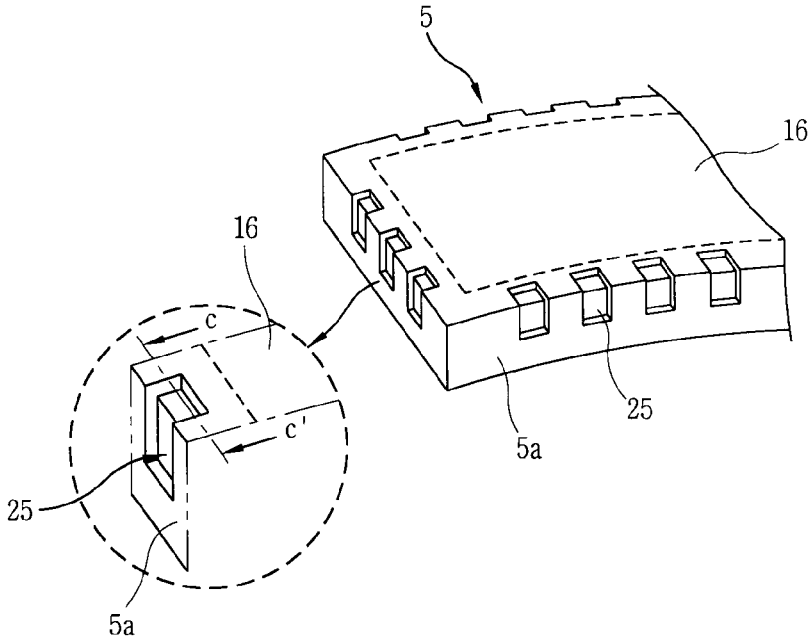
FIG. 6 is a partial cut perspective view illustrating beads formed on a shadow mask according to the preferred embodiment of the present invention.
Figure 8:
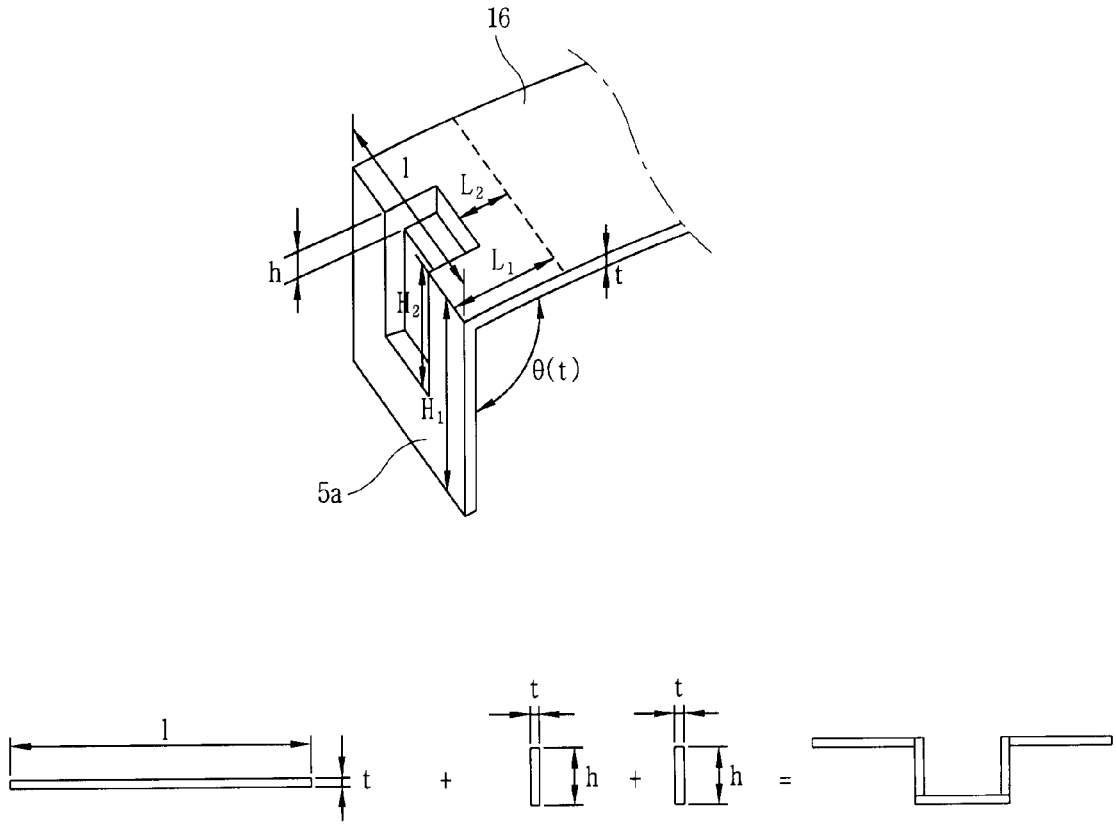
FIG. 8 is a partial cut perspective view illustrating value of the section modulus in accordance with shape of the bead of the preferred embodiment of the present invention.

As depicted in FIG. 6 and FIG. 8, a plurality of concave-compressed beads 25 according to the preferred embodiment of the present invention are formed on an ineffective surface 25 of a shadow mask 5 along a skirt portion 5*a* so as to be correspond to each faced side.

Figure 7:
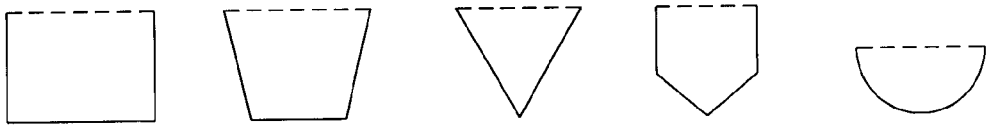
FIG. 7 illustrates cross sections of a bead of the preferred embodiment of the present invention.

Herein, cross section shape (C-C') of the concave-compressed beads 25 according to the preferred embodiment of the present invention can be changed as depicted in FIG. 7.

Figure 1:
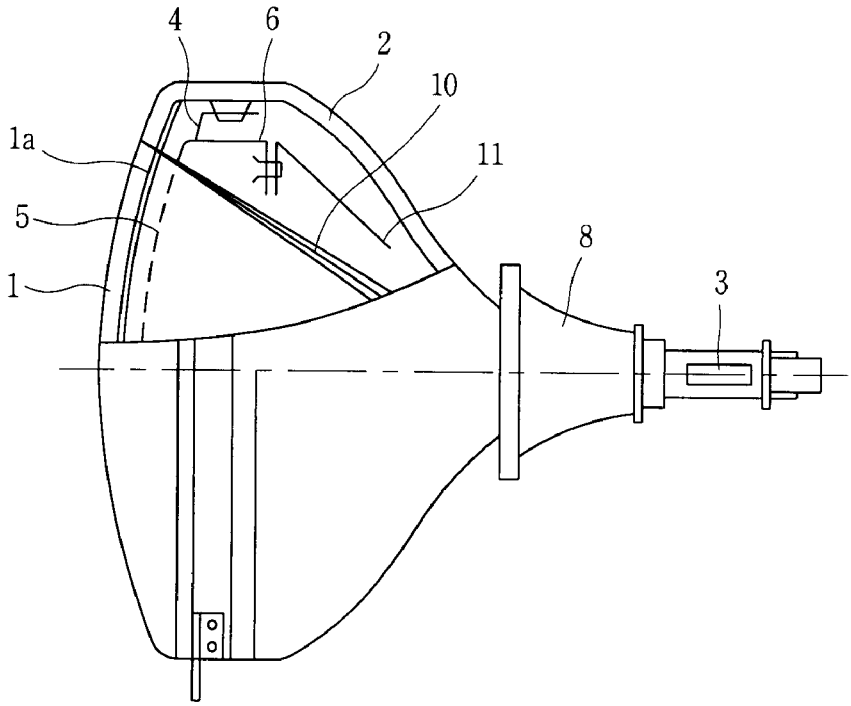
FIG. 1 BACKGROUND ART
FIG. 1 is a vertical cross-sectional view of the general color CRT.
Figure 2:
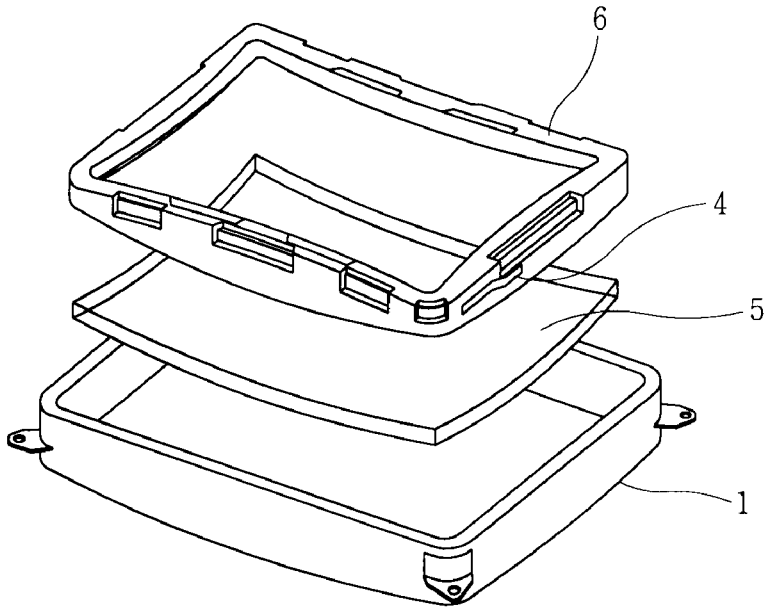
FIG. 2 BACKGROUND ART
FIG. 2 is a disassembling-perspective view of a panel structure adopting the conventional shadow mask.
Figure 3A:
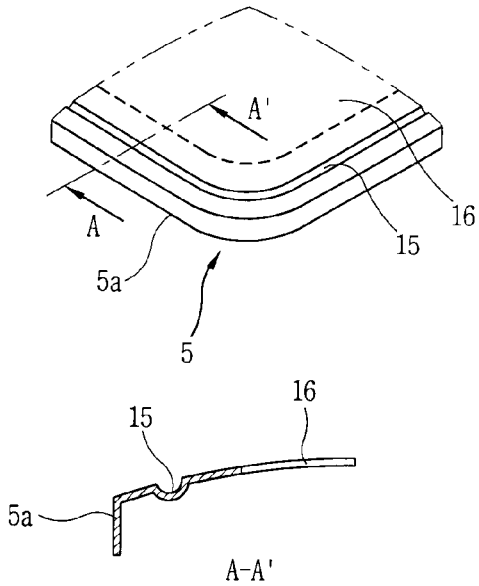
FIG. 3A BACKGROUND ART
FIGS. 3A and 3B are perspective views and schematic sectional views illustrating beads formed on the corner portion of the shadow mask according to the conventional technology.
Figure 3B:
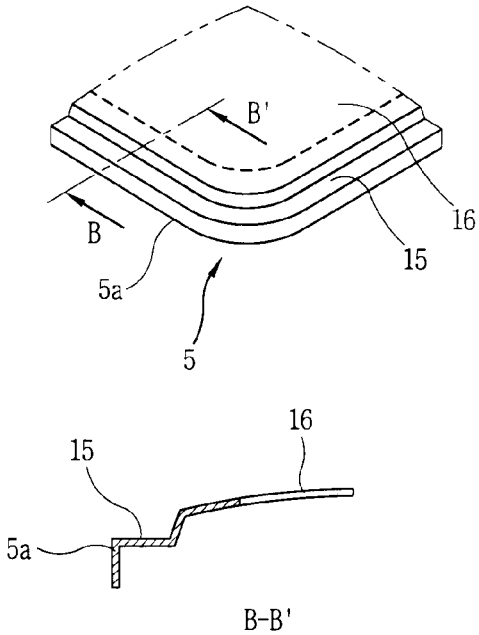
FIG. 3B BACKGROUND ART
Figure 4:
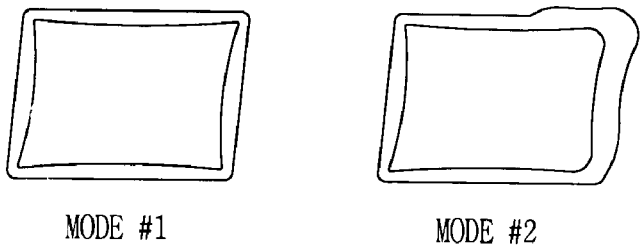
FIG. 4 BACKGROUND ART
FIG. 4 illustrates distortion of a shadow mask in accordance with vibration modes.
Figure 5:
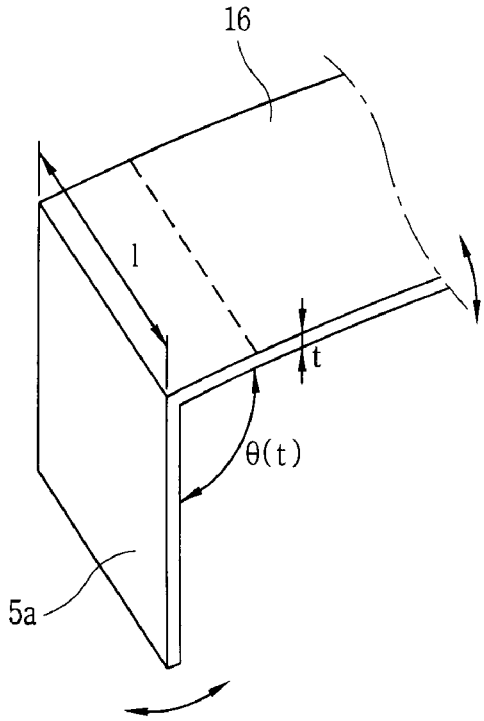
FIG. 5 BACKGROUND ART
FIG. 5 is a partial cut perspective view illustrating a shadow mask without a bead.

When the concave-compressed beads 25 according to the preferred embodiment of the present invention are formed on the shadow mask 5, in other words, in the case of the FIG. 8, value of the section modulus I resisting the relative vibration of the effective surface 16 and skirt portion 5*a* of the shadow mask 5 of the present invention can be illustrated as below [Equation 2] comparing to [Equation 1] of the FIG. 5 without bead.

$$I = \frac{lt^3}{12} + \frac{th^3}{12} + \frac{th^3}{12} \qquad \text{[Equation 2]}$$

Herein, the concave-compressed beads 25 have side walls having a certain height h, accordingly the section modulus I of the preferred embodiment of the present invention increases as $th^3/6$ in comparison to value of a section modulus without beads.

In addition, value of the height h of the concave-compressed bead 25 is a lot bigger than value of the thickness t of the bead 25, accordingly the stiffness of the effective surface 16 corresponding to the relative vibration of the skirt portion 5*a* increases a lot.

As depicted in FIG. 8, when the overall length of the ineffective surface of the shadow mask 5 is $L_1$ and the length from the dotted line to the concave-compressed bead is $L_2$, it is advisable to satisfy the range $0.3<L_2/L_1<0.8$.

Herein, when the range is lower than 0.3, the concave-compressed bead is too adjacent to the effective surface, accordingly landing errors of the electron beam can occur in fabrication of the shadow mask. When the range is more than 0.8, strengthening effect of the stiffness of the shadow mask is little.

In addition, when the overall length of the skirt portion is $H_1$ and the length of the concave-compressed bead on the skirt portion is $H_2$ (ref. FIG. 8), it is advisable to satisfy the range $0.3<H_2/H_1$.

Herein, when the range is lower than 0.3, the strengthening effect of the stiffness of the shadow mask is little.

As depicted above, when the concave-compressed beads 25 having shape are added, the relative angle between the effective surface 6 and skirt portion 5*a* is kept continually and the overall stiffness of the shadow mask 5 including the effective surface 16 increases a lot.

Figure 9:
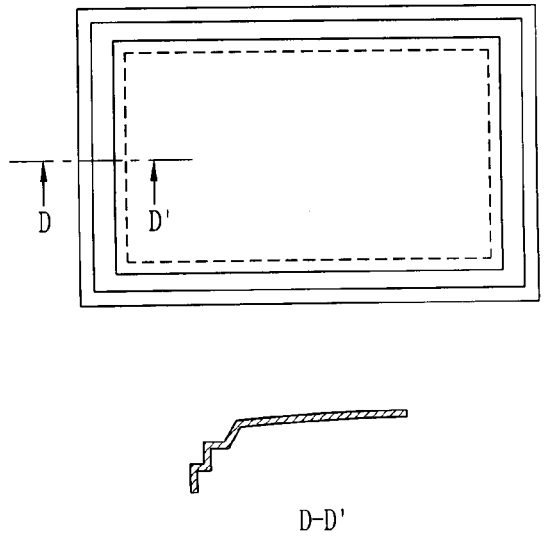
FIG. 9 is a plan view and sectional view illustrating a bead formed on a shadow mask according to the other preferred embodiment of the present invention.

Meanwhile, as depicted in FIG. 9, a stepped bead 25' having two steps according to the other embodiment of the present invention can be formed on the circumference of the shadow mask 5, its cross section D-D' shows two steps, and the stepped bead 25' can uniformly improve the stiffness of the shadow mask 5 along the overall circumference of the shadow mask 5.

As depicted in above, the present invention can prevent the distortion of a screen by forming the curved beads formed from the ineffective surface to the skirt portion of the shadow mask which is capable of improving the stiffness of the shadow mask by increasing value of the section modulus resisting the relative vibration occurred between the effective surface and skirt portion.

What is claimed is:

1. A shadow mask for a color CRT, comprising:

an effective surface formed with electron beam passage holes;

an ineffective surface having a certain width surrounding a circumference of the effective surface;

a skirt portion formed on the circumference of the ineffective surface with a predetermined height, wherein the skirt portion is a separate plane from the ineffective surface; and a plurality of concave-compressed beads formed from the ineffective surface to the skirt portion with two steps approximately parallel to the ineffective surface within each concave-compressed bead.

2. The shadow mask for the color CRT according to claim 1, wherein the plurality of the beads are formed along the circumference of the shadow mask with a certain interval.

3. The shadow mask for the color CRT according to claim 1, wherein the beads are sequentially formed along the circumference of the shadow mask, and wherein at least a portion of the skirt portion is approximately perpendicular to the ineffective surface.

4. The shadow mask as claimed in claim 1, wherein each of the plurality of concave-compressed beads has an interim height less than a total height of each bead.

5. The shadow mask for a color CRT according to claim 1, wherein an overall width of the ineffective surface is $W_1$, wherein a distance from an edge of the effective surface to an edge of a bead closest to the effective surface is $W_2$, and wherein $W_2/W_1$ is between approximately 0.3 and approximately 0.8.

6. The shadow mask for a color CRT according to claim 1, wherein an overall height of the skirt portion is $H_1$, and a height of a bead formed on the skirt portion is $H_2$, and wherein $H_2/H_1$ is greater than approximately 0.3.

7. The shadow mask for a color CRT according to claim 1, wherein the concave-compressed beads are configured to add strength and rigidity to the shadow mask to decrease the susceptibility of the effective surface to vibration, and wherein portions of faces of the concave-compressed beads are approximately parallel or perpendicular to the ineffective surface or the skirt portion.

8. The shadow mask for a color CRT according to claim 1, wherein the beads are formed at regular intervals along each side of the effective surface of the shadow mask.

9. A shadow mask for a cathode ray tube, comprising:

a first portion with holes for electron beam passage;

a second portion surrounding outer edges of the first portion;

a skirt portion formed along outer edges of the second portion; and a plurality of concave-compressed beads beads formed on both the second portion and the skirt portion so as to have two steps, wherein the beads are configured to provide strength and stiffness to the shadow mask, and wherein the second portion and the skirt portion are on separate planes.

10. The shadow mask for a cathode ray tube according to claim 9, wherein a height of the beads along the skirt portion is smaller than a height of the skirt portion.

11. The shadow mask for a cathode ray tube according to claim 10, wherein a ratio of the height of the beads along the skirt portion to the height of the skirt portion is approximately 0.3 or greater.

12. The shadow mask for a cathode ray tube according to claim 9, wherein a ratio $L_2/L_1$ of a width of the second portion $L_1$ to a distance between an edge of the first portion and an edge of a bead closest to the first portion $L_2$ is between approximately 0.3 and approximately 0.8.

13. The shadow mask for a cathode ray tube according to claim 9, wherein the beads are formed at regular intervals along each of the sides of the shadow mask, and wherein the second portion is an ineffective surface approximately perpendicular to the skirt portion.

14. The shadow mask as claimed in claim 9, wherein each bead has an interim width less than a total width of each bead.

15. A cathode ray tube that includes a shadow mask, wherein the improvement comprises a shadow mask having:

an effective region having a plurality apertures therethrough;

an ineffective portion separate from the effective portion in the same general plane as the effective region; and a skirt surrounding a circumference of the effective region, the skirt having a portion that extends approximately perpendicular to the plane of the effective region, wherein a plurality of indentations are formed in the skirt, each indentation extending into both the ineffective portion and the portion of the skirt so as to have at least two plane surfaces approximately parallel to each of the ineffective portion and the portion of the skirt, respectively, within each indention.

16. The cathode ray tube of claim 15, wherein a ratio $H_2/H_1$ of a height of each indentation along the portion of the skirt $H_2$ to a total height of the portion of the skirt $H_1$ is approximately 0.3 or greater.

17. The cathode ray tube of claim 15, wherein the indentations are formed at regular intervals along each side of the shadow mask, and wherein within each indention are at least four surfaces with two surfaces approximately perpendicular to the other two surfaces.

18. The cathode ray tube according to claim 15, wherein the indentations are configured to increase the stiffness of the shadow mask, and wherein the ineffective portion and the skirt are approximately perpendicular.

19. The cathode ray tube of claim 15, wherein a ratio $W_2/W_1$ of a width of the first portion of the skirt $W_1$ to a distance from the effective region to an edge of an indentation closest to the effective region $W_2$ is between approximately 0.3 and approximately 0.8.

20. A shadow mask for a color CRT, comprising:

an effective surface formed with electron beam passage holes;

an ineffective surface having a certain width and surrounding a circumference of the effective surface;

a skirt portion formed on a circumference of the ineffective surface with a predetermined height; and a plurality of concave-compressed beads respectively formed with at least two steps inside the concave-compressed beads, the steps being stepped from the ineffective surface to the skirt portion.

21. The shadow mask for a color CRT according to claim 20, wherein the steps of the concave-compressed beads each comprise:

a first step which includes a first vertical surface extended from the ineffective surface in a direction approximately parallel to a direction of a height of the skirt portion and a first horizontal surface extended from an edge of the first vertical surface in a direction approximately parallel to a direction of a width of the ineffective surface; and a second step which includes a second vertical surface extended from an edge of the first horizontal surface of the first step in the direction approximately parallel to the direction of the height of the skirt portion and a second horizontal surface extended from an edge of the second vertical surface in the direction approximately parallel to the direction of the width of the ineffective surface.

22. The shadow mask for a color CRT according to claim 20, wherein the concave-compressed beads are formed along the circumference of the shadow mask.

23. The shadow mask for a color CRT according to claim 22, wherein the concave-compressed beads are formed at regular intervals along each of the sides of the shadow mask.

24. The shadow mask for a color CRT according to claim 21, wherein an overall width of the ineffective surface is L1, wherein a distance from an edge of the effective surface to an edge of the first vertical surface is L2, and wherein L2/L1 is between 0.3 and 0.8.

25. The shadow mask for a color CRT according to claim 21, wherein an overall height of the skirt portion is H1, wherien a sum of a height of the first vertical surface and a height of the second vertical surface is H2, and wherein H2/H1 is greater than 0.3.

26. The shadow mask for a color CRT according to claim 21, wherein a height of the first vertical surface is smaller than a height of the second vertical surface.

27. The shadow mask for a color CRT according to claim 21, wherein a width of the first horizontal surface is greater than a width of the second horizontal surface.

* * * * *